US010024022B2

(12) United States Patent
Booth

(10) Patent No.: US 10,024,022 B2
(45) Date of Patent: Jul. 17, 2018

(54) WOVEN GEOTEXTILE FABRICS

(71) Applicant: Willacoochee Industrial Fabrics, Inc., Willacoochee, GA (US)

(72) Inventor: Eric Lee Booth, Willacoochee, GA (US)

(73) Assignee: Willacoochee Industrial Fabrics, Inc., Willacoochee ( * ) Notice: Subject to any disclaimer, the term of this patent is extended or adjusted under 35 U.S.C. 154(b) by 300 days.

(21) Appl. No.: 14/561,858

(22) Filed: Dec. 5, 2014

(65) Prior Publication Data

US 2015/0159305 A1 Jun. 11, 2015

Related U.S. Application Data

(60) Provisional application No. 61/914,201, filed on Dec. 10, 2013.

(51) Int. Cl.

| | |
|---|---|
| ***D03D 1/00*** | (2006.01) |
| ***D03D 15/00*** | (2006.01) |
| ***E02D 17/20*** | (2006.01) |
| ***E01C 7/32*** | (2006.01) |
| ***D03D 13/00*** | (2006.01) |
| *E02B 3/12* | (2006.01) |

(52) U.S. Cl.

CPC ..... *E02D 17/202* (2013.01); *D03D 13/008* (2013.01); *D03D 15/0088* (2013.01); *E01C 7/325* (2013.01); *D10B 2505/204* (2013.01); *E02B 3/126* (2013.01); *Y10T 442/3065* (2015.04)

(58) Field of Classification Search

None

See application file for complete search history.

(56) References Cited

U.S. PATENT DOCUMENTS

| | | | | |
|---|---|---|---|---|
| 4,417,828 | A | 11/1983 | de Winter | |
| 4,449,847 | A | 5/1984 | Scales et al. | |
| 4,502,815 | A | 3/1985 | Scales et al. | |
| 4,815,499 | A | 3/1989 | Johnson | |
| 5,091,247 | A | 2/1992 | Willibey et al. | |
| 5,108,224 | A * | 4/1992 | Cabaniss | D03D 15/00 139/426 R |
| 5,567,087 | A | 10/1996 | Theisen | |
| 5,616,399 | A | 4/1997 | Theisen | |
| 5,651,641 | A | 7/1997 | Stephens et al. | |
| 5,735,640 | A | 4/1998 | Meyer et al. | |
| 6,179,013 | B1 | 1/2001 | Gulya | |
| 6,502,360 | B2 | 1/2003 | Carr, III et al. | |
| 7,112,283 | B2 | 9/2006 | Stephens | |
| 7,740,420 | B2 | 6/2010 | Jones et al. | |
| 7,874,767 | B2 | 1/2011 | Jones et al. | |
| 8,088,117 | B2 | 1/2012 | Stephens et al. | |
| 8,252,705 | B2 | 8/2012 | King et al. | |
| 8,333,220 | B2 | 12/2012 | King | |
| 8,598,054 | B2 | 12/2013 | King et al. | |
| 2008/0207073 | A1 | 8/2008 | Jones | |
| 2009/0208288 | A1 | 8/2009 | Stephens et al. | |
| 2011/0206458 | A1 | 8/2011 | Jones et al. | |

(Continued)

*Primary Examiner* — Shawn Mckinnon

(74) *Attorney, Agent, or Firm* — Harness, Dickey & Pierce, P.L.C.; Anthony G. Fussner

(57) ABSTRACT

Disclosed are exemplary embodiments of woven geotextile fabrics. In exemplary embodiments, a geotextile has a water flow rate greater than 75 gallons per minute per square foot.

16 Claims, 3 Drawing Sheets

(56) References Cited

U.S. PATENT DOCUMENTS

| | | | | |
|---|---|---|---|---|
| 2011/0250448 | A1* | 10/2011 | Jones | C08L 23/12 428/359 |
| 2012/0052759 | A1* | 3/2012 | Wang | D03D 1/00 442/189 |
| 2013/0044623 | A1 | 2/2013 | Speight et al. | |
| 2013/0244521 | A1 | 9/2013 | Jones et al. | |
| 2014/0099850 | A1 | 4/2014 | King et al. | |
| 2014/0241817 | A1* | 8/2014 | Jones | D03D 9/00 405/302.7 |

* cited by examiner

WOVEN GEOTEXTILE FABRICS

CROSS-REFERENCE TO RELATED APPLICATION

This U.S. non-provisional patent application claims the benefit of and priority to U.S. provisional patent application No. 61/914,201 filed Dec. 10, 2013. The disclosure of the application identified in this paragraph is incorporated herein by reference in its entirety.

FIELD

The present disclosure relates to woven geotextile fabrics.

BACKGROUND

This section provides background information related to the present disclosure which is not necessarily prior art.

Geotextile fabrics are permeable fabrics that may be used in association with soil, for example, for soil reinforcement, retention, stabilization, etc. Three basic types of geotextile fabrics include woven, needle punched, and heat bonded. A woven geotextile fabric may include warp and weft yarns interwoven together with the warp yarns inserted over-and-under the weft yarns (or vice versa) to thereby secure the yarns together.

SUMMARY

This section provides a general summary of the disclosure, and is not a comprehensive disclosure of its full scope or all of its features.

Disclosed are exemplary embodiments of woven geotextile fabrics. In exemplary embodiments, a geotextile has a water flow rate greater than 75 gallons per minute per square foot.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 1:
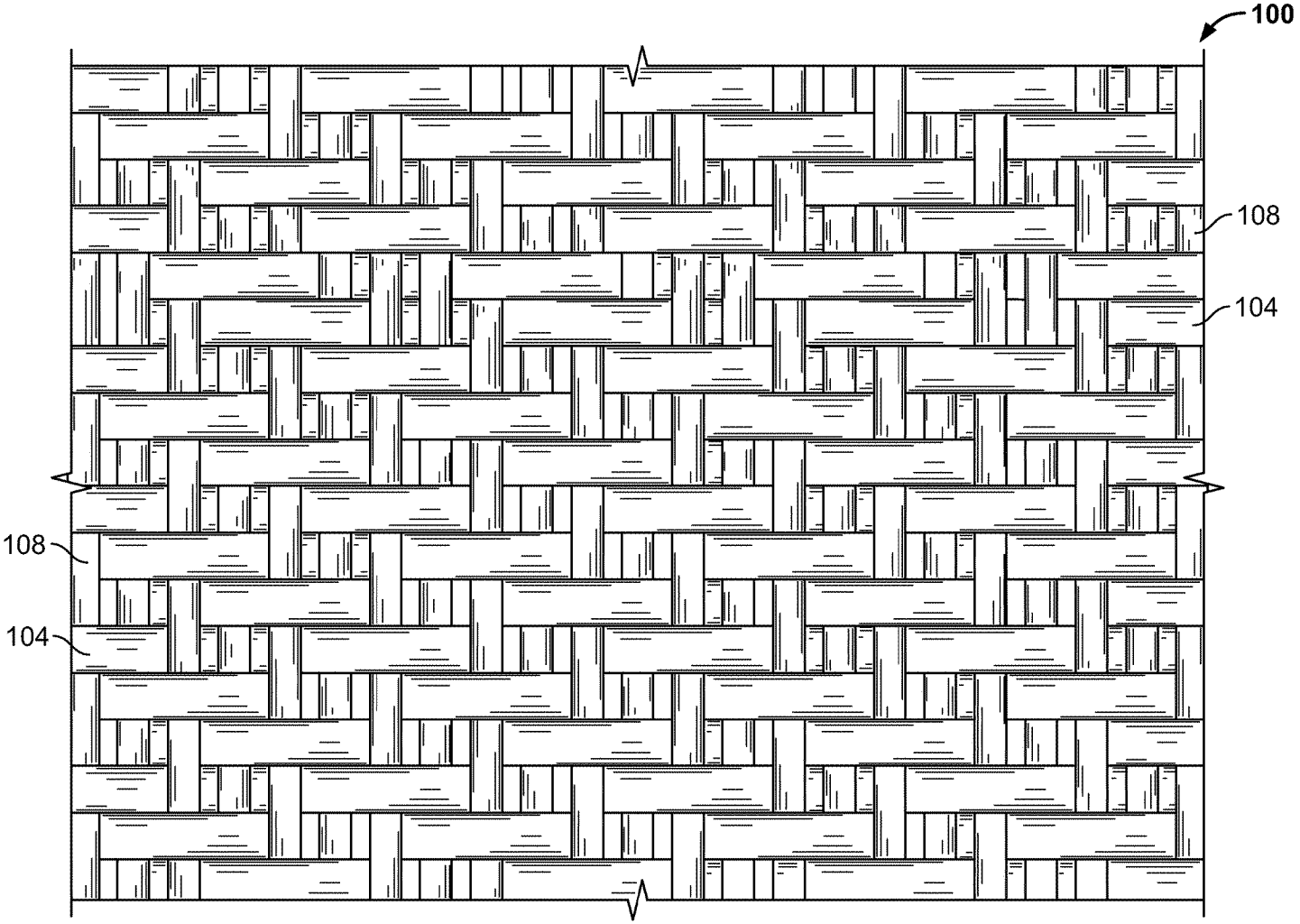
Figure 2:
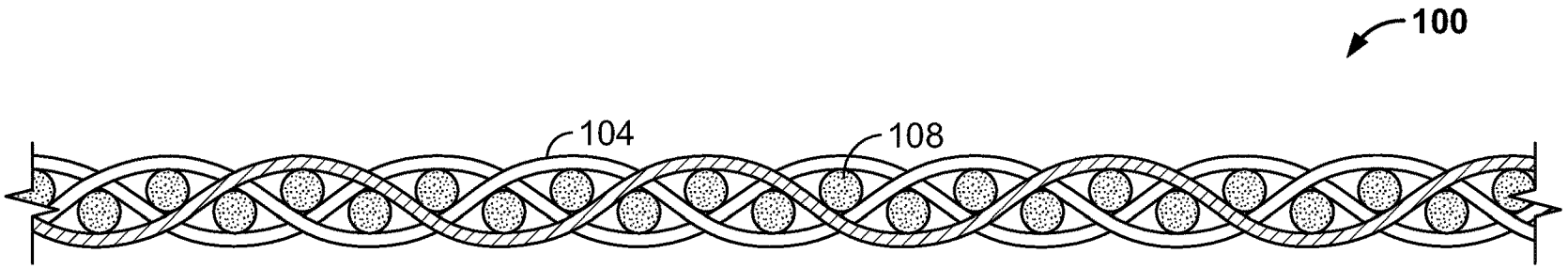
Figure 3:
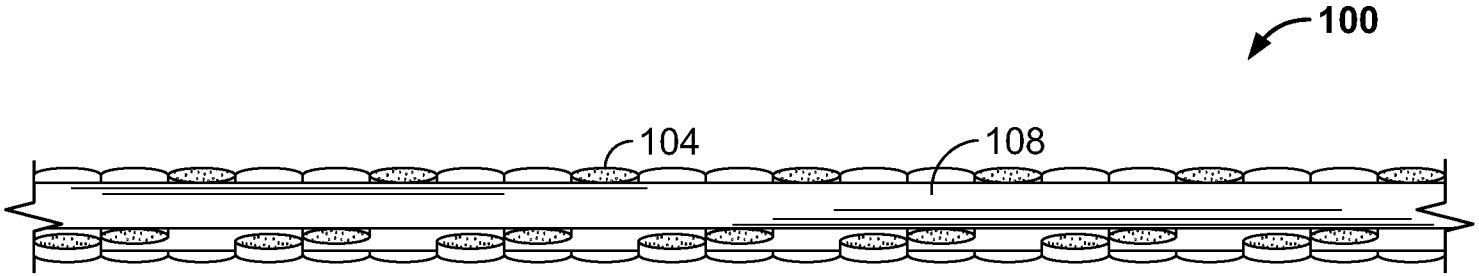

FIG. 1 is a top view of a woven geotextile fabric having high denier warp and weft yarns with different cross-sectional shapes according to an exemplary embodiment;

FIG. 2 is a cross-sectional side view of the woven geotextile fabric shown in FIG. 1, and illustrating the substantially rounded or circular cross-sectional shape of the weft yarns according to this exemplary embodiment; and FIG. 3 is another cross-sectional side view of the woven geotextile fabric shown in FIG. 1, and illustrating the substantially oval cross-sectional shape of the warp yarns according to this exemplary embodiment.

Corresponding reference numerals indicate corresponding parts throughout the several views of the drawings.

DETAILED DESCRIPTION

Example embodiments will now be described more fully with reference to the accompanying drawings.

Disclosed herein are exemplary embodiments of woven geotextile fabrics that may be used in various applications. In exemplary embodiments, a woven geotextile fabric may be configured to allow water to pass through the fabric at a high rate greater than 75 gallons per minute per square foot (gpm/ft$^2$), within a range from 76 gpm/ft$^2$ to 300 gpm/ft$^2$, etc.

The woven geotextile fabric may include one or more different types of yarn having different cross-sectional shapes or geometries. The fabric may be formed by layers of warp and weft yarns secured or interwoven together in a weave, construction, or pattern, which helps to enhance water flow and strength characteristics. By way of example, a woven geotextile fabric may have a 3/3 twill weave or a 2/2 twill weave. For example, warp yarns may interwoven with and substantially perpendicular to the weft yarns such that the warp yarns cross over and then under three weft yarns. By way of further example, a woven geotextile fabric may have warp yarns that are interwoven with and substantially perpendicular to the weft yarns such that the warp yarns cross over and then under two weft yarns. The warp and weft yarn systems may comprise one, two, three or more different types of yarns, e.g., yarn types with different cross-sectional shapes or geometries, monofilaments, tape yarns, fibrillated tapes, etc.

In exemplary embodiments of a woven geotextile fabric, the warp and weft systems comprise monofilament (e.g., polypropylene monofilament, polyester monofilament, polyethylene monofilament, nylon monofilament, combinations thereof, etc.). In one particular exemplary embodiment, a geotextile fabric includes only polypropylene monofilament. Alternative embodiments may include a woven geotextile fabric that includes other types of monofilament yarns, fibers, threads, and/or other yarn types such as tape yarns and/or fibrillated tapes, etc.

In exemplary embodiments of a woven geotextile fabric, the yarns have a high denier, such as within a range from 1300 to 5000 denier, 1300 to 2500 denier, etc. In exemplary embodiments, the woven geotextile fabric includes monofilaments, tape yarns, and/or fibrillated tapes having a denier of at least 1300 (e.g., 1300, 1400, 1500, 1600, 1700, 1800, 1900, 2000, etc.). The warp and weft yarns may have the same denier, or they may have deniers different from each other. For example, the warp yarns may comprise 1300 denier yarns, and the weft yarns may comprise 1800 denier yarns. As another example, the warp yarns may comprise 1600 denier yarns, and the weft yarns may comprise 1900 denier yarns. In yet another example, the warp yarns may comprise 1600 denier yarns, and the weft yarns may comprise 2000 denier yarns.

In exemplary embodiments, the warp yarns have cross-sectional shapes or geometries different than the cross-sectional shapes or geometries of the weft yarns. In one particular embodiment, the weft yarns have a round, substantially circular cross-sectional shape, whereas the warp yarns have an oval cross-sectional shape with a width greater than its thickness or height. In this example, the round weft yarns may have an average diameter of 22 mils. Also in this example, the oval shape of the warp yarns may have a width of 34 mils with a maximum thickness at the center of 7.5 mils, which is the thickest point. Alternative embodiments may include a woven geotextile fabric having warp and/or weft yarns with other or additional cross-sectional shapes, geometries, and/or sizes. For example, the warp and weft yarns may both have a round, substantially circular cross-sectional shape. Or, for example, the warp and weft yarns may both have an oval cross-sectional shape. As yet another example, the warp yarns may have a round, substantially circular cross-sectional shape, and the weft yarns may have an oval cross-sectional shape with a width greater than its thickness or height.

In exemplary embodiments, the woven geotextile fabric may consist of a single warp set or system and a single weft set or system. In this example, the first or warp system and the second or weft system may each be comprised of high denier polypropylene monofilament. The first and second (or warp and weft) sets of monofilaments may be interwoven together (e.g., twill weave, etc.) to form a dimensionally stable network, which allows the yarns to maintain their relative position. By way of example only, the weft system may comprise polypropylene monofilament yarn having a rounded or substantially circular cross-sectional shape. The warp system may comprise polypropylene monofilament yarn having an oval cross-sectional shape.

With reference now to the figures, FIG. 1 illustrates an exemplary embodiment of a woven geotextile fabric 100 embodying one or more aspects of the present disclosure. As shown in FIG. 1, the woven geotextile fabric 100 includes warp and weft yarns, threads, or fibers 104, 108, respectively. The fabric 100 is configured to allow water to pass through open channels through the fabric 100 at a high rate greater than 75 gallons per minute per square foot (gpm/ft$^2$), such as within a range from 76 gpm/ft$^2$ to 300 gpm/ft$^2$, etc.

In exemplary embodiments, the warp yarns 104 cross over and then under three weft yarns 108. The fabric 100 may have a 3/3 twill weave. In other exemplary embodiments, the warp yarns cross over and then under two weft yarns. The fabric may have a 2/2 twill weave. The warp and weft systems may comprise polypropylene monofilament having a high denier, e.g., within a range from 1300 to 5000 denier, within a range from 1300 to 2500 denier, etc.

As shown in FIGS. 2 and 3, the warp yarns 104 have cross-sectional shapes or geometries different than the cross-sectional shapes or geometries of the weft yarns 108. In this illustrated embodiment, the warp yarns 104 have an oval cross-sectional shape with a width greater than its thickness or height, whereas the weft yarns 108 have a round or circular cross-sectional shape. By way of example only, the round weft yarns 108 may have an average diameter of 22 mils. The oval shape of the warp yarns 104 may have a width of 34 mils with a maximum thickness at the center of 7.5 mils, which is the thickest point. Alternative embodiments may include a differently configured geotextile fabric, e.g., having different warp and/or weft yarns (e.g., having rectangular cross-sectional shapes, etc.), different weave patterns, etc. For example, the warp and weft yarns 104, 108 may both have a round, substantially circular cross-sectional shape. Or, for example, the warp and weft yarns 104, 108 may both have an oval cross-sectional shape. As yet another example, the warp yarns 104 may have a round, substantially circular cross-sectional shape, and the weft yarns 108 may have an oval cross-sectional shape with a width greater than its thickness or height.

Aspects of the present disclosure will be further illustrated by the following five examples of woven geotextile fabrics including warp and weft systems comprising high denier monofilament yarns, where the cross-sectional shapes of the warp yarns and weft yarns are different from one another. These examples (as are all examples provided herein) are merely illustrative, and do not limit this disclosure to the construction of these particular woven geotextile fabrics or the properties and characteristics thereof.

Example 1

In a first example, a woven geotextile fabric included a single warp system and a single weft system. The warp system was comprised of 1300 or 1500 denier polypropylene monofilament yarns. The weft system was comprised of 1800 denier polypropylene monofilament yarns. The weft and warp yarns were woven to form a dimensionally stable network, which allows the yarns to maintain their relative position. The weft yarns had a rounded or circular cross-sectional shape, whereas the warp yarns had an oval (or football) cross-sectional shape different than the weft yarns. Dimensionally, the round weft yarns had an average diameter of 22 mils. The oval shape of the warp yarns had a width of 34 mils with a maximum thickness at the center of 7.5 mils, which is the thickest point. The fabric had a density of 27.5 threads per inch in the warp direction and a density of 20 threads per inch in the weft or fill direction. The fabric had a 2/2 twill weave pattern in which weft yarns are interwoven with and substantially perpendicular to the warp.

The first example of a woven geotextile fabric had a water flow rate of at least 80 gallons per minute per square foot (gpm/ft$^2$) or 3260 liters per minute per square meter (lpm/m$^2$) as measured per ASTM standard D-4491. The first example had a tensile modulus at 2% strain cross direction of at least 30,000 pounds per foot (lbs/ft) or at least 437.8 kilonewtons per meter (kN/m) as measured per ASTM standard D-4595, and an Apparent Opening Size (AOS) of 0.425 millimeter (mm) or less as measured per ASTM standard D-4751. The first example also had a permittivity of at least 1.09 sec$^{-1}$ as measured per ASTM standard D-4491 and ultraviolet (UV) resistance (500 hours) of at least 80% as measured per ASTM D-4355 standard.

Example 2

In a second example, a woven geotextile fabric included a single warp system and a single weft system. The warp system was comprised of 1300 or 1600 denier polypropylene monofilament yarns. The weft system was comprised of 1900 denier polypropylene monofilament yarns. The weft and warp yarns were woven to form a dimensionally stable network, which allows the yarns to maintain their relative position. The weft yarns had a rounded or circular cross-sectional shape, whereas the warp yarns had an oval cross-sectional shape different than the weft yarns. The fabric had a density of 27.5 threads per inch in the warp direction and a density of 21 threads per inch in the weft or fill direction. The fabric had a 2/2 twill weave pattern in which weft yarns are interwoven with and substantially perpendicular to the warp yarns.

The second example of a woven geotextile fabric had a water flow rate of at least 80 gpm/ft$^2$ or 3260 lpm/m$^2$ as measured per ASTM standard D-4491. The second example had a tensile modulus at 2% strain cross direction of at least 51,000 lbs/ft or 744 kN/m as measured per ASTM standard D-4595 and an Apparent Opening Size (AOS) of 0.425 mm or less as measured per ASTM standard D-4751. The second example also had a permittivity of at least 1.09 sec$^{-1}$ as measured per ASTM standard D-4491 and ultraviolet (UV) resistance (500 hour) of at least 80% as measured per ASTM D-4355 standard.

Example 3

In a third example, a woven geotextile fabric included a single warp system and a single weft system. The warp system was comprised of 1300 or 1600 denier polypropylene monofilament yarns. The weft system was comprised of 2000 denier polypropylene monofilament yarns. The weft and warp yarns were woven to form a dimensionally stable network, which allows the yarns to maintain their relative position. The weft yarns had a rounded or circular cross-sectional shape, whereas the warp yarns had an oval cross-sectional shape different than the weft yarns. The fabric had a density of 27.5 threads per inch in the warp direction and a density of 21 threads per inch in the weft or fill direction. The fabric had a 2/2 twill weave pattern in which weft yarns are interwoven with and substantially perpendicular to the warp yarns.

The third example of a woven geotextile fabric had a water flow rate of at least 125 gpm/ft$^2$ or 5093.8 lpm/m$^2$ as measured per ASTM standard D-4491. The third example had a tensile modulus at 2% strain cross direction of at least 55,000 lbs/ft or 802.3 kN/m as measured per ASTM standard D-4595 and an Apparent Opening Size (AOS) of 0.425 mm or less as measured per ASTM standard D-4751. The third example also had a permittivity of at least 1.67 sec$^{-1}$ as measured per ASTM standard D-4491 and ultraviolet (UV) resistance (500 hours) of at least 80% as measured per ASTM D-4355 standard.

Example 4

In a fourth example, a woven geotextile fabric included a single warp system and a single weft system. The warp system was comprised of 1300 or 1600 denier polypropylene monofilament yarns. The weft system was comprised of 2000 denier polypropylene monofilament yarns. The weft and warp yarns were woven to form a dimensionally stable network, which allows the yarns to maintain their relative position. The weft yarns had a rounded or circular cross-sectional shape, whereas the warp yarns had an oval cross-sectional shape different than the weft yarns. The fabric had a density of 27.5 threads per inch in the warp direction and a density of 28.5 threads per inch in the weft or fill direction. The fabric had a 3/3 twill weave pattern in which weft yarns are interwoven with and substantially perpendicular to the warp yarns.

The fourth example of a woven geotextile fabric had a water flow rate of at least 80 gpm/ft$^2$ or 3260 lpm/m$^2$ as measured per ASTM standard D-4491. The fourth example had a tensile modulus at 2% strain cross direction of at least 90,000 lbs/ft or 1313.3 kN/m as measured per ASTM standard D-4595 and an Apparent Opening Size (AOS) of 0.425 mm or less as measured per ASTM standard D-4751. The fourth example also had a permittivity of at least 1.09 sec$^{-1}$ as measured per ASTM standard D-4491 and ultraviolet (UV) resistance (500 hours) of at least 80% as measured per ASTM D-4355 standard.

Example 5

In a fifth example, a woven geotextile fabric included a single warp system and a single weft system. The warp system was comprised of 1300 or 1600 denier polypropylene monofilament yarns. The weft system was comprised of 2000 denier polypropylene monofilament yarns. The weft and warp yarns were woven to form a dimensionally stable network, which allows the yarns to maintain their relative position. The weft yarns had a rounded or circular cross-sectional shape, whereas the warp yarns had an oval cross-sectional shape different than the weft yarns. The fabric had a density of 27.5 threads per inch in the warp direction and a density of 30 threads per inch in the weft or fill direction. The fabric had a 3/3 twill weave pattern in which weft yarns are interwoven with and substantially perpendicular to the warp yarns.

The fifth example of a woven geotextile fabric had a water flow rate of at least 125 gpm/ft$^2$ or 5093.8 lpm/m$^2$ as measured per ASTM standard D-4491. The fifth example had a tensile modulus at 2% strain cross direction of at least 115,000 lbs/ft or 1677.6 kN/m as measured per ASTM standard D-4595 and an Apparent Opening Size (AOS) of 0.425 mm or less as measured per ASTM standard D-4751. The fifth example also had a permittivity of at least 1.67 sec$^{-1}$ as measured per ASTM standard D-4491 and ultraviolet (UV) resistance (500 hours) of at least 80% or more as measured per ASTM D-4355 standard.

Advantageously, all of the above examples of woven geotextile fabrics had water flow rates greater than 75 gpm/ft$^2$ while also having a relatively high tensile modulus at 2% strain cross direction of at least 30,000 lbs/ft and relatively small Apparent Opening Size (AOS) of 0.425 mm or less. The example geotextile fabrics also had good resistance to ultraviolet deterioration, rotting, and biological degradation, and were inert to commonly encountered soil chemicals. The example woven textile fabrics may have roll dimensions of 15 ft by 300 ft (or 4.6 m×91.5 m) and roll area of 500 yd$^2$ (or 418 m$^2$).

Exemplary embodiments of woven geotextile fabrics disclosed herein may be used in a wide range of applications. By way of example only, woven geotextile fabrics may be used to help support and extend the life of parking lots, paved and unpaved roadways, loading docks, etc. by providing separation and/or stabilization of the different components of the structure. The fabric gives the project a permeable separation and/or stabilization layer, keeps the aggregate and subsoils from mixing, allows water drainage, and enhances structural integrity of the subgrade while helping to reduce costs.

Proper installation includes the following four steps: preparation of the subgrade, placement of the geotextile, placement of the aggregate, and compaction of the aggregate. The description of the following installation process is provided for purpose of illustration only as the specific site conditions and variables may require alterations and changes to the installation process. Regardless of the subgrade, the site should be cleared of any debris (large stones, tree stumps, and vegetation) to prevent or inhibit puncture or damage of the fabric. Typical roadway preparation includes removal of all vegetation and topsoil. Unsuitable subgrade areas are excavated and backfilled with suitable material before proper installation can take place.

The geotextile may be rolled out on the prepared subgrade site where it will be easily accessible to construction equipment while still complying with the layout plan. On soft subgrades, the aggregate placement and fabric layout may preferably begin on firm soil at the site perimeter to create a solid anchor point from which the fabric can be rolled onto softer sections. Placement of the fabric is achieved by rolling the geotextile on the subgrade. The geotextile is most commonly laid with the direction of construction traffic. Some project designs or dimensions can alter the layout of the geotextile. The panels may be overlapped end to end and side to side in the same direction of the aggregate placement. Recommended overlap ranges from 1.5 feet to 3.0 feet according to subgrade strength.

Adjacent edges can also be sewn together. Sewn seams may be required if the geotextile is providing significant tensile strength reinforcement. This is usually this case for example, when it is being applied to a very soft subgrade. Fabric orientation and sewn seam strength are important design parameters in these applications. Sewing the panels together onsite may require the use of a portable sewing machine. Pre-sewn panels may also be obtained.

To hold the fabric in place until the aggregate is installed, it is acceptable to use either pins, weights, and/or soil. The fabric may be folded, overlapped, or cut to conform to curves in the design. The direction of the fold or overlap may preferably be in the direction of the construction and can be held in place using any of the above mentioned items.

The aggregate is placed and spread on top of the geotextile using normal acceptable construction methods. The geotextile may be held in place with pins, rocks, and/or soil, etc. on the leading edge to prevent it from lifting during the initial placement of the first aggregate. The aggregate may preferably be back dumped. Trucks or other construction vehicles should preferably not be driven directly on the geotextile. Tracked bulldozers may be used to spread the aggregate. A low ground pressure model is well suited for working on soft subgrades.

There may preferably be no less than 6 inches of lift. To limit rutting to less than 4 inches, the first lift may be as thick as necessary. The bulldozer operator may preferably position the blade at a slight upward angle to prevent stressing of the fabric during spreading. The same procedure may be followed for additional loads until the fabric is completely covered. Additional aggregate may be needed in certain areas to obtain suitable stability. This is determined by the amount of rutting observed during the spreading process. On soft subgrades, care should be taken to avoid inadvertent movement of the geotextile during aggregate placement.

Vehicles should not drive directly on the geotextile. Equipment working directly on top of the aggregate should not make any sudden stops or turns as this can damage the geotextile. If damage is observed to the geotextile during installation, a patch may be placed over the damage area that is large enough to cover the damaged area as well as extending over the surrounding undamaged area. After the patching is complete, the aggregate can then be replaced and the project can continue.

Standard compaction methods can be used unless very soft soils are present. A vibratory compactor may preferably be used to perform the final compaction. The first phase with the vibratory compactor may preferably be done with the vibration off for several passes. This process may be repeated for several passes with the vibration on. If weak areas are observed during the final compaction, this is a sign of inadequate thickness of the aggregate and the areas should be filled with additional aggregate and compacted.

Throughout the construction process, conditions of the construction should be monitored for any deviations from what was anticipated. Changes or differences in the subgrade strength, rutting, or any other negative observations should be addressed to determine if corrective action such as additional aggregate is needed.

Exemplary embodiments disclosed herein may thus provide one or more (but not necessarily any or all) of the following advantages or benefits. For example, exemplary embodiments may have superior or exceptional tensile modulus at 2% strain cross direction (e.g., at least 30,000 pounds per foot, etc.), water flow properties (e.g., greater than 75 gallons per minute, etc.), and AOS (e.g., 0.425 mm or less, etc.). The woven geotextile fabrics disclosed herein may be used for stabilization, separation, filtration, reinforcement, confinement, and erosion control for a wide variety of site conditions from moderate to severe. For example, an exemplary embodiment of a woven geotextile fabric disclosed herein may help insure long term performance of transportation systems and consistent load distribution in construction application. Exemplary woven geotextile fabrics disclosed herein may provide high soil confinement for greater load distribution, may be durable, may have superior damage resistance, may have high modulus for immediate structural support, and/or may have a unique weave optimizing both strength and filtration properties.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A geotextile fabric consisting of a single warp yarn system that includes warp yarns and a single weft yarn system that includes weft yarns that are interwoven with the warp yarns, the geotextile configured to have a water flow rate of at least 90 gallons per minute per square foot, a tensile modulus at 2% strain cross direction of at least 30,000 pounds per foot, and an apparent opening size of no more than 0.425 millimeters, and wherein:

the weft yarns are interwoven with the warp yarns such that the geotextile fabric has a twill weave pattern;

the warp yarns have an oval cross-sectional shape; and the weft yarns have a circular cross-sectional shape;

the warp yarns comprise 1300 or 1600 denier polypropylene monofilament yarns, the weft yarns comprise 2000 denier polypropylene monofilament yarns, the weft yarns are interwoven with the warp yarns such that the geotextile fabric has a 2/2 twill weave pattern, the geotextile fabric had a density of 27.5 threads per inch in a warp direction and a density of 21 threads per inch in a weft direction, the geotextile fabric is configured to have a water flow rate of at least 125 gallons per minute per square foot, a tensile modulus at 2% strain cross direction of at least 55,000 pounds per foot, a permittivity of at least 1.67 $sec^{-1}$ and ultraviolet (UV) resistance (500 hours) of at least 80%.

2. The geotextile fabric of claim 1, wherein the geotextile fabric consists of only one said single weft yarn system and only one said single warp yarn system, wherein the cross-sectional shape of each weft yarn of said single weft yarn system is the same as the cross-sectional shape of the other weft yarns, and wherein the cross-sectional shape of each warp yarn of said single warp yarn system is the same as the cross-sectional shape of the other warp yarns.

3. The geotextile fabric of claim 1, wherein the cross-sectional shape of each weft yarn is the same as the cross-sectional shape of the other weft yarns, and wherein the cross-sectional shape of each warp yarn is the same as the cross-sectional shape of the other warp yarns.

4. The geotextile fabric of claim 1, wherein the geotextile fabric is configured to have an apparent opening size of less than 0.425 millimeters.

5. The geotextile fabric of claim 1, wherein the geotextile fabric is configured to have a water flow rate within a range of 125 to 300 gallons per minute per square foot.

6. The geotextile fabric of claim 1, wherein the geotextile fabric is configured to have an apparent opening size of 0.425 millimeters.

7. The geotextile fabric of claim 1, wherein the warp yarns have an oval cross-sectional shape with a width greater than a height.

8. The geotextile fabric of claim 1, wherein the warp and weft yarns are interwoven to form a dimensionally stable network.

9. The geotextile fabric of claim 1, wherein:

the warp yarns comprise polypropylene monofilament having an oval cross-sectional shape with a width of about 34 mils and a maximum thickness of about 7.5 mils; and the weft yarns comprise polypropylene monofilament having a circular cross-sectional shape and having an average diameter of about 22 mils.

10. A geotextile fabric consisting of a single warp yarn system that includes warp yarns and a single weft yarn system that includes weft yarns that are interwoven with the warp yarns, the geotextile configured to have a water flow rate of at least 90 gallons per minute per square foot, a tensile modulus at 2% strain cross direction of at least 30,000 pounds per foot, and an apparent opening size of no more than 0.425 millimeters, and wherein:

the weft yarns are interwoven with the warp yarns such that the geotextile fabric has a twill weave pattern;

the warp yarns have an oval cross-sectional shape; and the weft yarns have a circular cross-sectional shape;

wherein the warp yarns comprise 1300 or 1600 denier polypropylene monofilament yarns, the weft yarns comprise 2000 denier polypropylene monofilament yarns, the weft yarns are interwoven with the warp yarns such that the geotextile fabric has a 3/3 twill weave pattern, the geotextile fabric had a density of 27.5 threads per inch in a warp direction and a density of 30 threads per inch in a weft direction, the geotextile fabric is configured to have a water flow rate of at least 125 gallons per minute per square foot, a tensile modulus at 2% strain cross direction of at least 115,000 pounds per foot, a permittivity of at least 1.67 $sec^{-1}$ and ultraviolet (UV) resistance (500 hours) of at least 80%.

11. The geotextile fabric of claim 10, wherein the geotextile fabric consists of only one said single weft yarn system in which all weft yarns have the same cross-sectional shape, and only one said single warp yarn system in which all warp yarns have the same cross-sectional shape.

12. The geotextile fabric of claim 10, wherein a cross-sectional shape of the warp yarns is an oval cross-sectional shape with a width greater than its height.

13. The geotextile fabric of claim 10, wherein the geotextile fabric is configured to have an apparent opening size of less than 0.425 millimeters.

14. The geotextile fabric of claim 10, wherein the geotextile fabric is configured to have a water flow rate within a range of 125 to 300 gallons per minute per square foot.

15. The geotextile fabric of claim 10, wherein the warp and weft yarns are interwoven to form a dimensionally stable network.

16. The geotextile fabric of claim 10, wherein the geotextile fabric consists of only one said single weft yarn system and only one said single warp yarn system, wherein each weft yarn of said single weft yarn system has a cross-sectional shape the same as the cross-sectional shape of the other weft yarns, wherein each warp yarn of said single warp yarn system has a cross-sectional shape the same as the cross-sectional shape of the other warp yarns, and wherein the cross-sectional shape of the weft yarns is different than the cross-sectional shape of the warp yarns.

* * * * *